US010465484B2

(12) United States Patent
Turner et al.

(10) Patent No.: US 10,465,484 B2
(45) Date of Patent: Nov. 5, 2019

(54) GRAVEL PACKING SYSTEM AND METHOD

(71) Applicant: Saudi Arabian Oil Company, Dhahran (SA)

(72) Inventors: Robert John Turner, Dhahran (SA); Brian A. Roth, Dhahran (SA)

(73) Assignee: Saudi Arabian Oil Company (SA)

( * ) Notice: Subject to any disclaimer, the term of this patent is extended or adjusted under 35 U.S.C. 154(b) by 207 days.

(21) Appl. No.: 15/631,977

(22) Filed: Jun. 23, 2017

(65) Prior Publication Data

US 2018/0371879 A1 Dec. 27, 2018

(51) Int. Cl.

| | |
|---|---|
| ***E21B 43/04*** | (2006.01) |
| ***E21B 43/08*** | (2006.01) |
| ***E21B 43/10*** | (2006.01) |
| ***E21B 43/12*** | (2006.01) |
| ***E21B 33/02*** | (2006.01) |

(52) U.S. Cl.

CPC ..... *E21B 43/045* (2013.01); *E21B 33/02* (2013.01); *E21B 43/04* (2013.01); *E21B 43/08* (2013.01); *E21B 43/10* (2013.01); *E21B 43/12* (2013.01)

(58) Field of Classification Search

CPC ..... E21B 43/04

See application file for complete search history.

(56) References Cited

U.S. PATENT DOCUMENTS

| | | | | |
|---|---|---|---|---|
| 2,877,852 | A * | 3/1959 | Bashara | E21B 43/08 166/230 |
| 4,016,931 | A | 4/1977 | Cryar, Jr. | |
| 4,951,751 | A | 8/1990 | Jennings, Jr. | |
| 5,293,935 | A * | 3/1994 | Arterbury | B01D 29/111 166/228 |
| 6,684,951 | B2 * | 2/2004 | Restarick | E21B 17/003 166/227 |
| 7,380,600 | B2 | 6/2008 | Willberg et al. | |
| 8,505,628 | B2 | 8/2013 | Panga et al. | |
| 8,662,172 | B2 | 3/2014 | Panga et al. | |
| 8,916,506 | B2 | 12/2014 | Panga et al. | |
| 9,394,474 | B2 | 7/2016 | Brooks et al. | |
| 2004/0084177 | A1 * | 5/2004 | Wang | E21B 43/084 166/234 |
| 2005/0121192 | A1 | 6/2005 | Hailey, Jr. et al. | |
| 2007/0039741 | A1 * | 2/2007 | Hailey, Jr. | E21B 34/10 166/376 |

(Continued)

OTHER PUBLICATIONS

International Search Report and Written Opinion for Related PCT Application PCT/US2017/0363367 dated Aug. 3, 2017.

*Primary Examiner* — Shane Bomar

(74) *Attorney, Agent, or Firm* — Bracewell LLP; Constance G. Rhebergen

(57) ABSTRACT

A gravel pack tool for use in a well including a base pipe selectively deployed in the well that defines an outer annulus between the base pipe and an inner wall of the well, a dissolvable plug in a side wall of the base pipe, and tubing positioned within the base pipe that is in selective communication with a source of a bead forming fluid. When the bead forming fluid flows through the tubular and into the well, compounds in the bead forming fluid react to form beads within the outer annulus. The beads collect along a screen that circumscribes the base pipe and define a gravel pack which through which formation fluid is directed prior to entering production tubing in the wellbore.

19 Claims, 7 Drawing Sheets

(56) References Cited

U.S. PATENT DOCUMENTS

| | | | | |
|---|---|---|---|---|
| 2012/0000641 | A1* | 1/2012 | Panga | C09K 8/80 166/51 |
| 2013/0075090 | A1* | 3/2013 | Woiceshyn | E21B 43/08 166/250.12 |
| 2014/0041869 | A1* | 2/2014 | Weaver | C09K 8/528 166/278 |
| 2014/0318777 | A1* | 10/2014 | Fontenelle | E21B 37/06 166/278 |
| 2015/0240612 | A1* | 8/2015 | Fu | C09K 8/62 166/308.1 |
| 2015/0308238 | A1 | 10/2015 | Langlais | |
| 2016/0002998 | A1* | 1/2016 | Wang | E21B 33/1208 166/382 |
| 2016/0137910 | A1* | 5/2016 | Chang | C09K 8/80 166/280.2 |
| 2016/0289543 | A1* | 10/2016 | Chang | C09K 8/64 |
| 2019/0078420 | A1* | 3/2019 | Han | E21B 43/025 |

* cited by examiner

GRAVEL PACKING SYSTEM AND METHOD

BACKGROUND OF THE INVENTION

1. Field of Invention

Embodiments disclosed herein relate generally to downhole tools for improved oil and gas recovery in oil field applications. The present disclosure relates to forming a gravel pack in a wellbore. More specifically, the present disclosure relates to disposing a bead forming fluid in the wellbore, and exposing the bead forming fluid to conditions downhole that induce formation of beads to form the gravel pack.

2. Description of Prior Art

Hydrocarbon production from subterranean formations commonly includes a well completed in either cased hole or open-hole condition. In cased-hole applications, a well casing is placed in the well and the annulus between the casing and the well is filled with cement. Perforations are typically made through the casing and the cement into one or more production interval zones to allow formation fluids (such as, hydrocarbons) to flow from the production interval zones into the casing. A production string is placed inside the casing, creating an annulus between the casing and the production suing. Formation fluids flow into the annulus and then into the production string to the surface through tubing associated with the production string. In open-hole applications, the production string is directly placed inside the well without casing or cement. Formation fluids flow into the annulus between the formation and the production string and then into production string to surface.

The production of hydrocarbons from unconsolidated or poorly consolidated formations results in the production of sand along with the hydrocarbons. Produced sand is undesirable for many reasons. It is abrasive to components within the well, such as tubing, pumps and valves, and must be removed from the produced fluids at the surface. Further, produced sand partially or completely clogs the well, thereby requiring an expensive workover. In addition, the sand flowing from the formation leaves a cavity, which results in the formation caving and collapsing of the casing. A completion assembly is oftentimes run into a well before the well begins producing hydrocarbon fluids from the surrounding formation. The completion assembly sometimes includes a base pipe and a screen disposed thereabout, and where an amount of gravel slurry is pumped downhole through a wash pipe inserted in the base pipe, and forced into an annulus outside the screen to form a gravel pack.

SUMMARY

Disclosed herein is an example method for gravel-less gravel packing for use in a well and which includes introducing a bead forming fluid to a system disposed in the well, where the system is made up of tubing and a base pipe so that the bead forming fluid flows into an outer annulus defined between the base pipe and the well. Further included in this example method are retaining the bead forming fluid in the outer annulus, and forming a gravel pack in the well by controlling an operating condition of the bead forming fluid so that beads are formed in the outer annulus. In an alternative, the beads are substantially spherical, and the bead forming fluid includes primary and secondary liquid precursors to form the beads. The method optionally further includes receiving a production fluid from a formation that surrounds the well and that flows through the gravel pack. In this alternative, liquid and gas is included in the production fluid. In an alternative, dissolvable material is disposed in an opening in a sidewall of the base pipe, the method further includes maintaining conditions in the well that at which the dissolvable material degrades so that fluid communication occurs through the opening. The method optionally includes using a sand screen to impede the flow of beads into an opening formed radially through a sidewall of the base pipe. In one example, communication is provided through a port in the sidewall of the base pipe, and fluid is flowed through the port from the outer annulus. In this example, a sleeve is selectively disposed adjacent the port, and wherein communication through the port is provided by sliding the sleeve axially away from the port.

Also disclosed herein is an example of a gravel pack system for use in a well and which includes an annular base pipe disposed in the well and which defines an outer annulus between the base pipe and sidewalls of the well, a flow barrier in the outer annulus, a screen circumscribing the base pipe, an opening formed radially through a sidewall of the base pipe, a material in the opening that degrades under certain conditions in the wellbore so that fluid communicates through the opening, a port in a sidewall of the base pipe that is selectively opened and closed, and a tubular in the base pipe that is in selective communication with a source of a bead forming fluid and that is in communication with the outer annulus, so that when the bead forming fluid is introduced into the tubular, the bead forming fluid is directed into the outer annulus. In one embodiment, the source of bead forming fluid is a tank and a pump on a surface above an opening of the well. In an example, an inner annulus is defined between the tubular and the base pipe, and a flow barrier is disposed in the inner annulus.

Another example of a gravel pack system for use in a well is disclosed herein and which includes a base pipe selectively deployed in the well which defines an outer annulus between the base pipe and an inner wall of the well, a dissolvable plug disposed in an opening formed through a side wall of the base pipe, a tubular positioned within the base pipe that is in selective communication with a source of a bead forming fluid, and bead forming fluid disposed in the outer annulus. Optionally, the dissolvable plug degrades in response to exposure to a downhole condition. The system optionally includes a screen circumscribing the base pipe. In this example the screen interferes with entry of at least one of sand and beads into an inner annulus formed between the base pipe and the tubular. In one example, a hydraulic fluid flow path extends from the tubular into the outer annulus, and which is guided by a packer disposed in an inner annulus between the tubular and the base pipe.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

Figure 1:
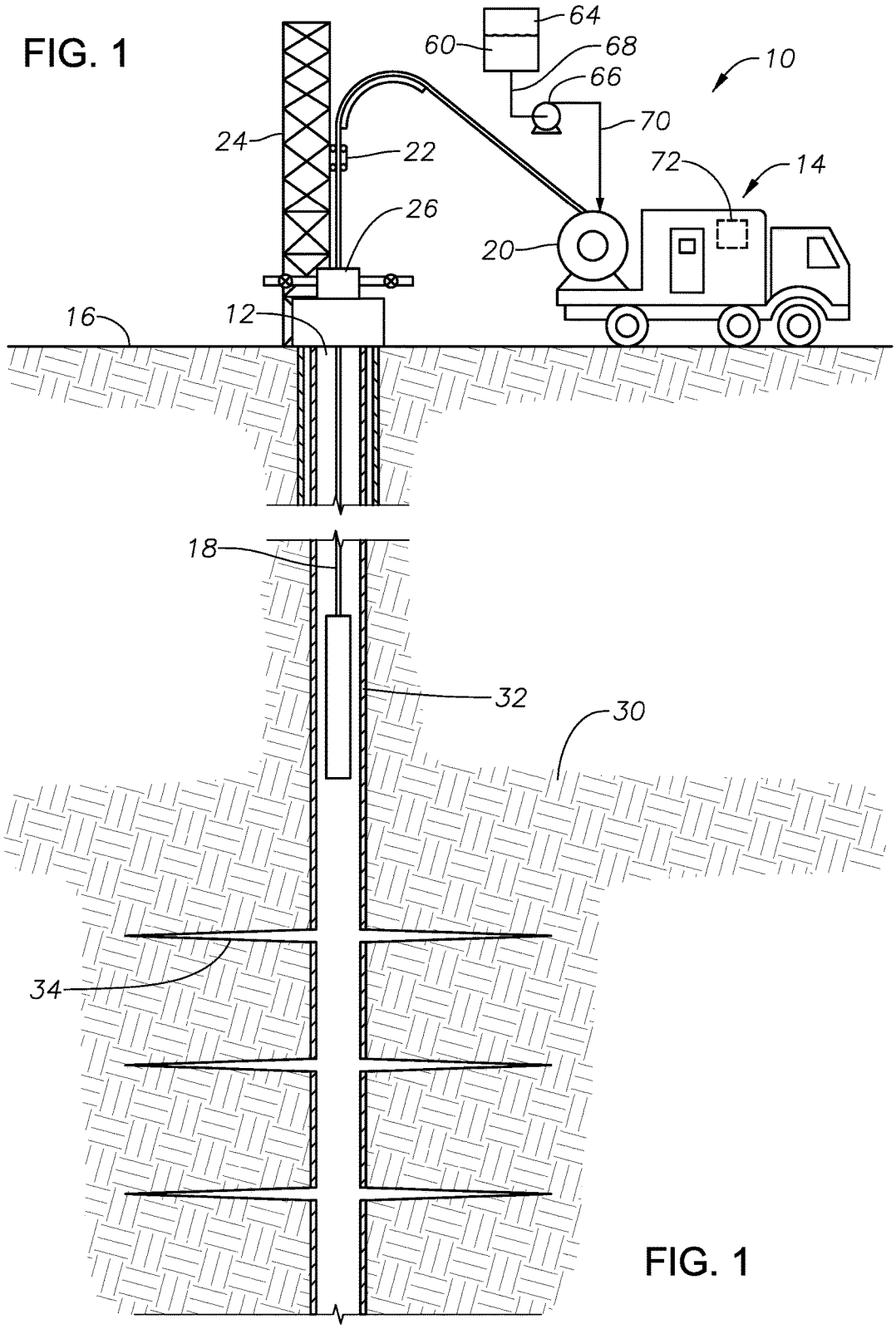
FIG. 1 is a side, partial sectional view of an example of a downhole system being deployed in a wellbore for use in gravel packing.

The foregoing aspects, features, and advantages of the present technology will be further appreciated when considered with reference to the following description of preferred embodiments and accompanying drawings, wherein like reference numerals represent like elements. The following is directed to various exemplary embodiments of the disclosure. The embodiments disclosed should not be interpreted, or otherwise used, as limiting the scope of the disclosure, including the claims. In addition, those having ordinary skill in the art will appreciate that the following description has broad application, and the discussion of any embodiment is meant only to be exemplary of that embodiment, and not intended to suggest that the scope of the disclosure, including the claims, is limited to that embodiment. Like numbers refer to like elements throughout. In an embodiment, usage of the term "about" includes +/−5% of the cited magnitude. In an embodiment, usage of the term "substantially" includes +/−5% of the cited magnitude.

FIG. 1 shows in a side partial sectional view one example of a downhole system 10 being used for conducting gravel pack operations in a wellbore 12. The embodiment of the downhole system 10 illustrated includes a surface truck 14 mounted on surface 16 which is above an opening of wellbore 12, and wherein coiled tubing 18 is being inserted into wellbore 12. The coiled tubing 18 is shown stored on a reel 20 that is provided on surface truck 14. In the example method, coiled tubing 18 is pulled from reel 20 and forced into wellbore 12 using an injector head 22 shown mounted on a rig mast 24. In an alternative, a string of jointed pipe or wash pipe (not shown) is inserted into wellbore 12 for the gravel packing process instead of coiled tubing 18. The injector head 22 is shown forcing the coiled tubing 18 through a wellhead assembly 26 which provides pressure control on the opening of wellbore 12.

A formation 30 is shown circumscribing wellbore 12 and casing 32 lines the wellbore 12. The casing 32 provides support to wellbore walls, and isolates the wellbore 12 from sand and other particulate matter that might otherwise enter the wellbore 12 from formation 30. Perforations 34 are shown extending radially outward from side walls of wellbore 12 and into formation 30, perforations 34 provide fluid channels for production fluid (not shown) within formation 30 to be routed into wellbore 12.

Figure 2:
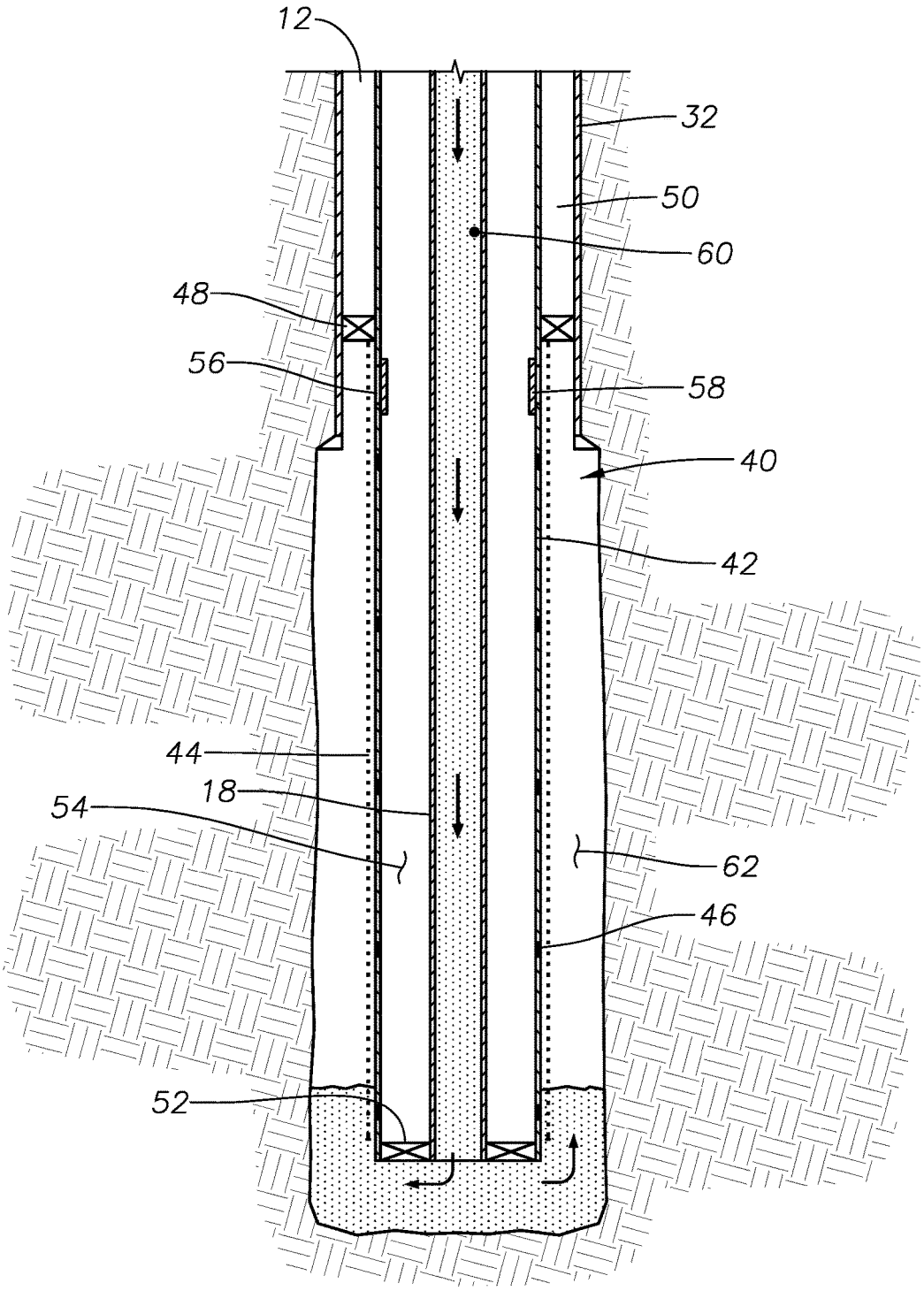
FIGS. 2 and 3 are side sectional views of a detailed portion of an embodiment of the downhole system of FIG. 1, and where a bead forming fluid is being discharged from the downhole system and into an annulus between a base pipe and walls of the wellbore.

Illustrated in a side sectional view in FIG. 2 is a detail of another step of the gravel pack operations where a lower end of the coiled tubing 18 is inserted within a gravel pack assembly 40 shown mounted within a lower end of wellbore 12. Examples exists where gravel pack assembly 40 is disposed into wellbore 12 on tubing 18. In an alternative, gravel pack assembly 40 is lowered into wellbore 12 on a line (not shown) prior to the step of inserting tubing 18 in wellbore 12. In the example of FIG. 2, the gravel pack assembly 40 includes a tubular base pipe 42 and a screen 44 that is provided along the outer surface of base pipe 42. Plugs 46 are shown provided strategically in openings that are formed radially through the side wall of base pipe 42. As described in more detail below, the plugs 46 are degradable and rupture, dissolve, or otherwise are removed when introduced to downhole conditions of pressure and temperature and/or fluids. Fluid communication takes place across the openings with removal or loss of the plugs 46. It is well within the capabilities of those skilled in the art to provide a material for plugs 46 that can withstand downhole conditions for a period of time, and degrade after a designated period of time of being exposed to downhole conditions. A packer 48 is shown extending radially in the annular space between base pipe 42 and an inner surface of casing 32. Packer 48 defines a barrier to axial flow in an annulus 50 formed in the annular space between the base pipe 42 and the casing 32. A device 52 is provided in the lower end of the annulus 54 that is between coiled tubing 18 and base pipe 42. Device 52 blocks communication between a lower end of wellbore 12 and annulus 54. In an alternative, bottom end of the coiled tubing 18 inserts into a shoe (not shown) mounted in a lower end of base pipe 42 and which is used in lieu of the device 52. Embodiments exist where the coiled tubing 18 of FIG. 1, or wash pipe (not shown) extends from surface 16 through the length of wellbore 12, and having a lower terminal end that inserts within device 52. In the example of FIG. 2, a portion of wellbore 12 is lined with casing 32 and another portion is "open hole" or bare. It should be pointed out that the gravel pack system and method described herein is not limited to the embodiment of FIG. 2, but can be used in wellbores having casing along their entire lengths, or wellbores having no casing.

Further included in the base pipe 42 is a port 56 which extends radially through a side wall of base pipe 42 and is shown proximate packer 48 and distal from device 52. A sliding sleeve 58 is shown set adjacent the port 56; and in its orientation of FIG. 2, the sleeve 58 blocks communication through side wall of base pipe 42 and between annulus 54 and the outside of base pipe 42. Further in the example of FIG. 2, a bead forming fluid 60 is shown being pumped down coiled tubing 18 and directed to a lower end of wellbore 12 and between device 52. As illustrated by arrows, fluid discharges from a lower end of coiled tubing 18 and it is redirected into an annulus 62 that is defined between the walls of wellbore 12 and an outer surface of base pipe 42. Referring back to FIG. 1, fluid 60 shown stored in a tank 64 on surface, where the fluid 60 drains to a pump 66 via a suction line 68. Fluid is pressurized in pump 66, and exits pump 66 via discharge line 70, which carries the pressurized fluid to reel 20. Once within reel 20, fluid 60 is routed into the coiled tubing 18, exits the coiled tubing 18, and into annulus 62 of FIG. 2. An example of the fluid 60 is described in application having Ser. No. 14/943,956 ("Application no. '956"), filed Nov. 17, 2015, the entire disclosure of which is incorporated by reference herein for all purposes. In an alternative, a controller 72 is provided with the surface truck 14 for controlling operations of the downhole system 10 as well as operation of moving equipment in the downhole system 10.

Figure 3:
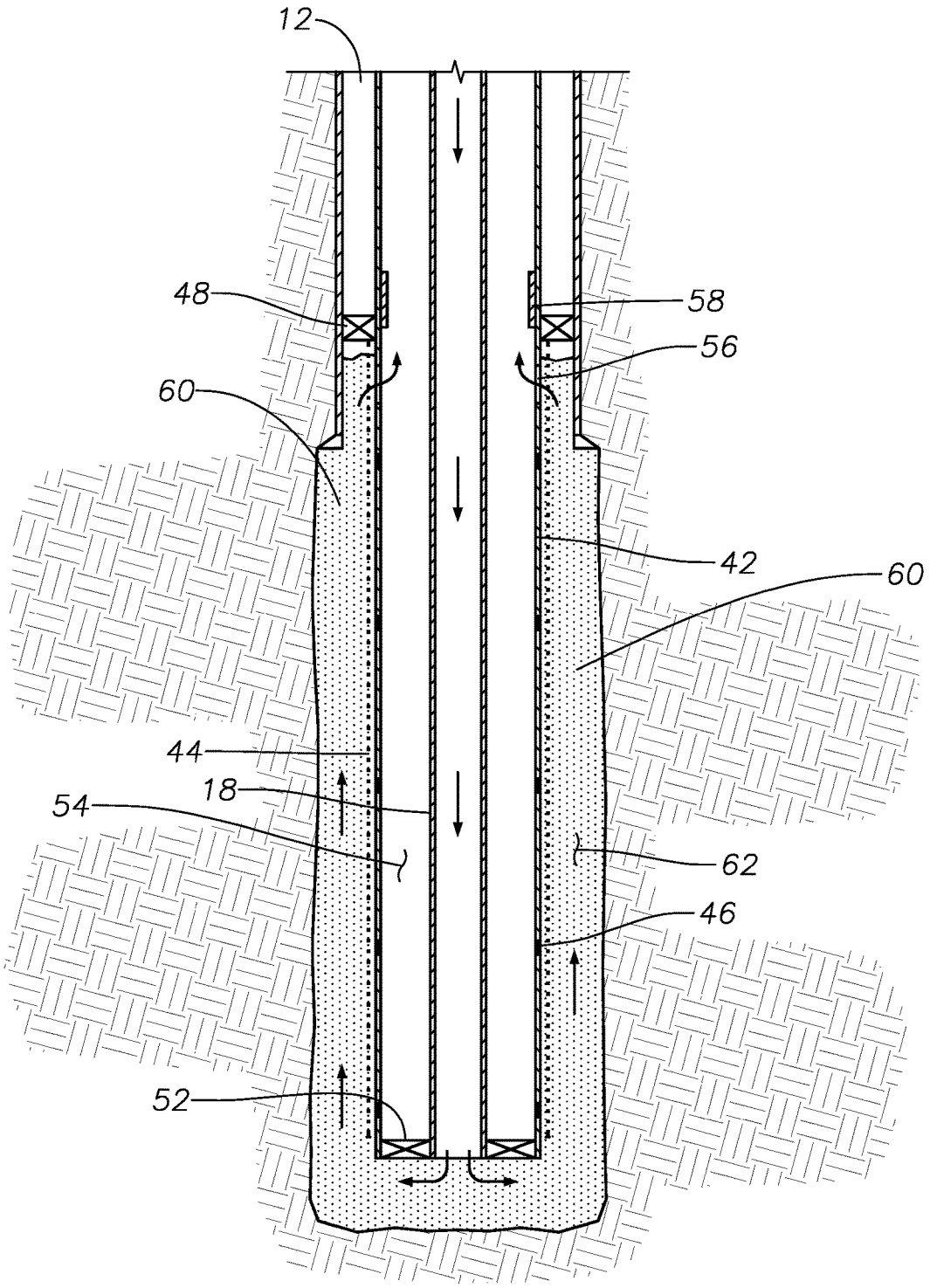

Shown in a side sectional view in FIG. 3 is an example of a next step of the gravel pack operations described herein. Here, an additional amount of fluid 60 is provided into the coiled tubing 18. Fluid 60 discharges from tubing 18 and flows up in the annulus 62. The sleeve 58 is moved away from ports 56 thereby allowing fluid 60 within annulus 62 to flow into annulus 54. In one example of operation, the volume within annulus 62 is estimated so that the volume of fluid 60 pumped downhole is at least as great as the estimated volume.

Figure 4:
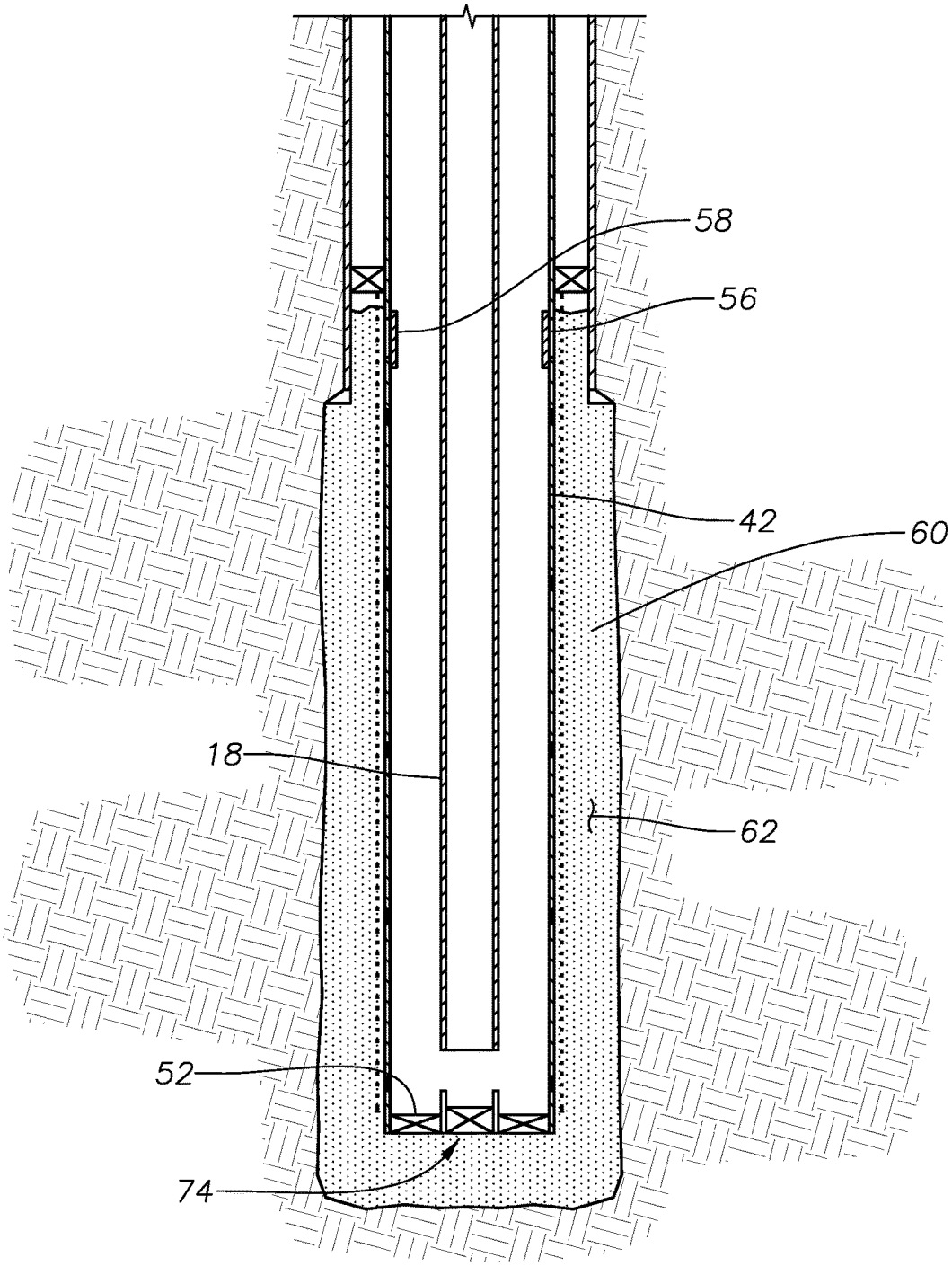
FIG. 4 is a side sectional view of a tubular of the downhole system of FIG. 1 being removed from an attachment downhole.

FIG. 4 depicts an example step where the fluid 60 has been delivered into the annulus 62. After fluid 60 has substantially filled annulus 62, the sleeve 58 is moved back to adjacent the ports 56 thereby trapping fluid 60 within annulus 62. Further in the example of FIG. 4, the coiled tubing 18 is shown having been drawn upward and is no longer in fluid communication with annulus 62. In an alternative, a valve 74 is mounted within device 52 that automatically closes with removal of coiled tubing 18, and thereby blocking communication between the space below device 52 and the space within base pipe 42.

Figure 5:
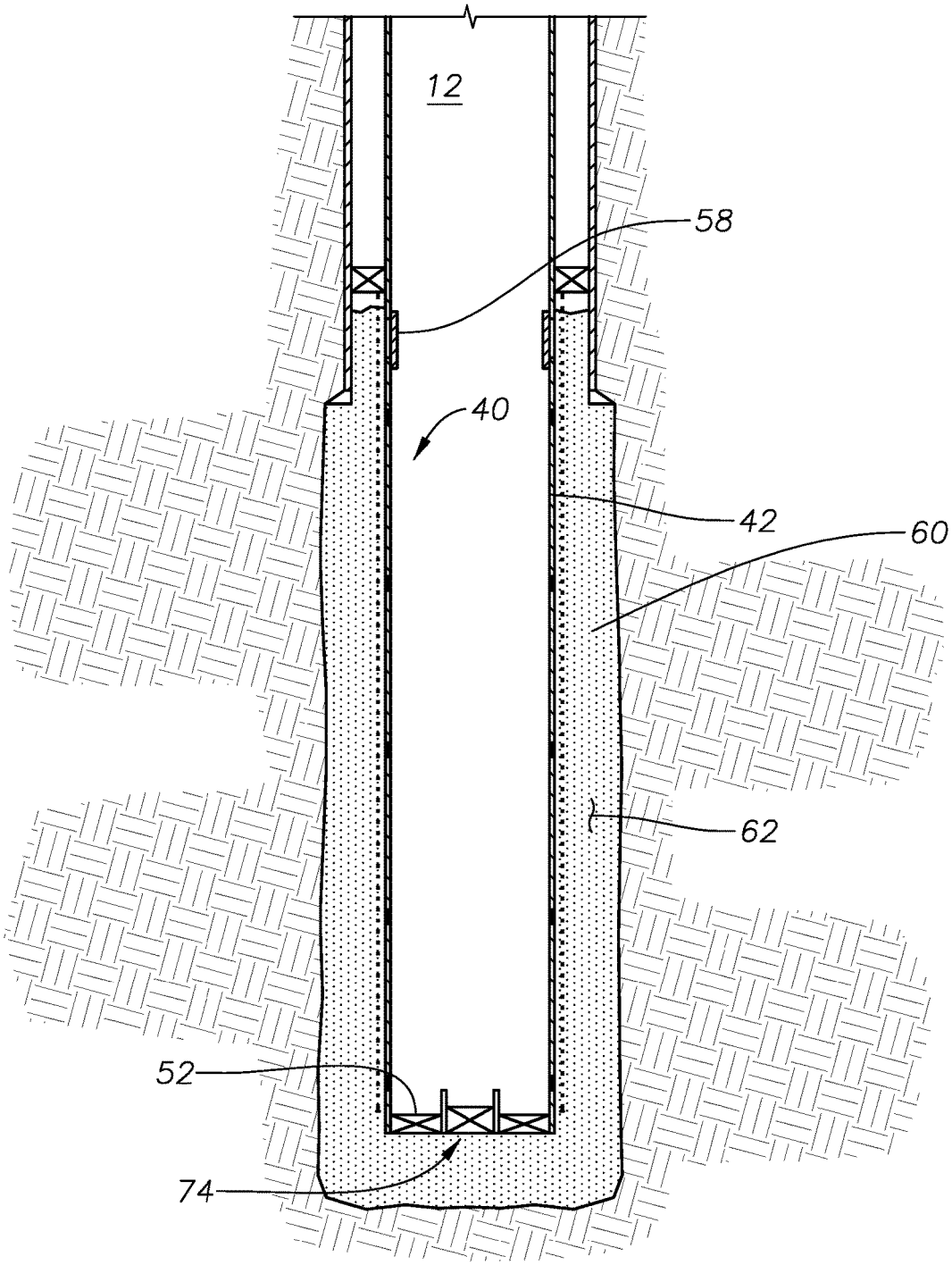
FIG. 5 is a side sectional view of the region of the wellbore of FIGS. 2 and 3 with the bead forming fluid trapped in the annulus.

FIG. 5 shows in a side sectional view an example of the gravel packing operation after the coiled tubing 18 of FIG. 4 has been removed from wellbore thereby leaving the gravel pack assembly 40 within wellbore 12 and with the fluid 60 trapped in the space between the gravel pack assembly 40 and lateral and lower side walls of wellbore 12. Further in this example, valve 74 remains closed thereby ensuring that fluid 60 remains in that annular space.

Figure 6:
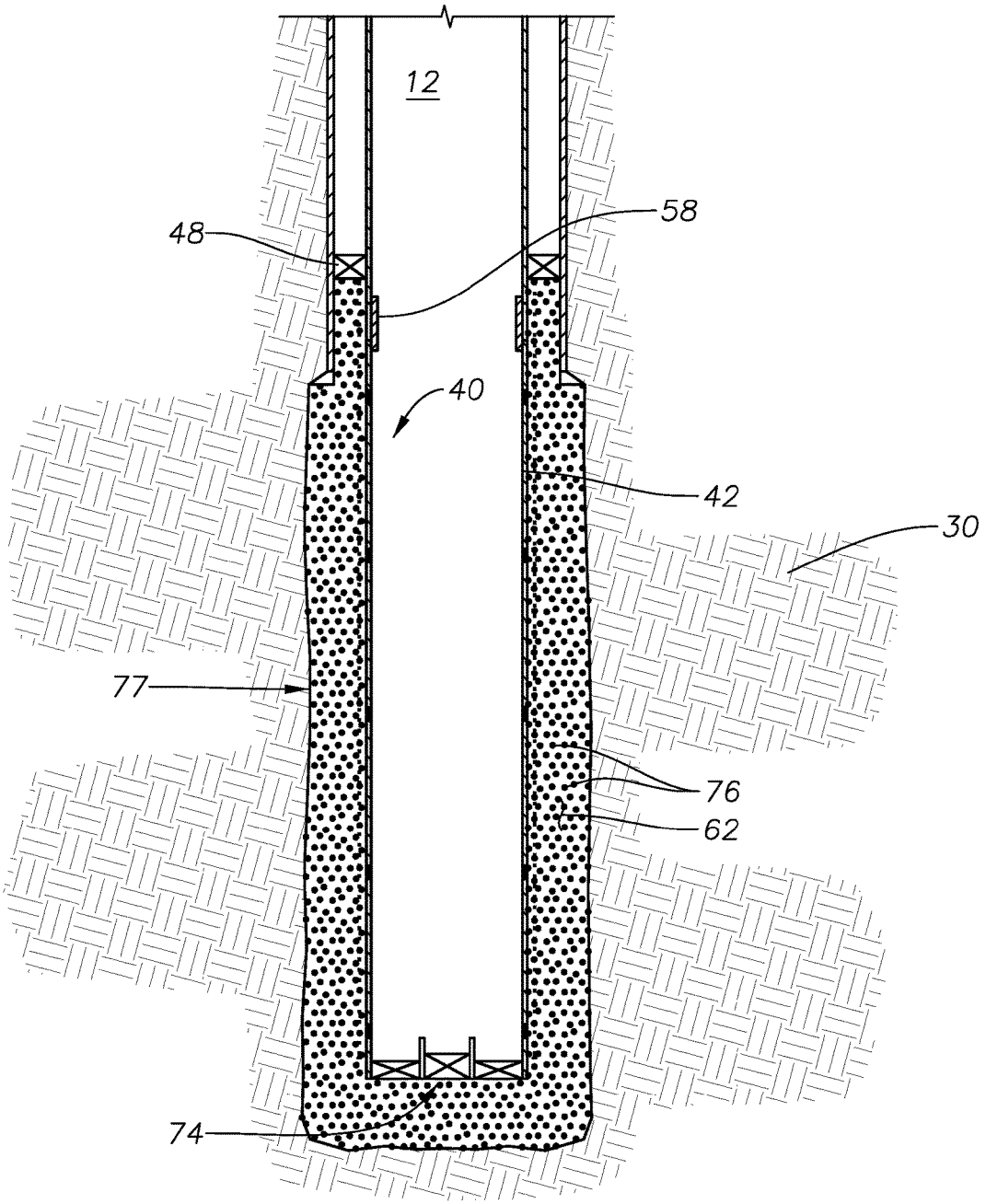
FIG. 6 is a side sectional view of the wellbore of FIG. 5 where beads are being formed in the fluid in the annulus.

In the step of gravel packing depicted in FIG. 6, over time, and as described in Application no. '956, the bead forming compound in the fluid 60 reacts to the conditions within wellbore 12 and begins to form beads 76. In an example the beads 76 are substantially spherical, and grow to fill the space between the gravel pack assembly 40 and side walls of wellbore 12, i.e, annulus 62 and the space in the wellbore 12 below packers 52. The beads 76 form an example of a gravel pack 77 which filters particulate matter from reservoir fluid being produced from formation 30 and that then enters wellbore 12. Similarly, if bead forming compound in fluid 60 is introduced into perforations 34 (FIG. 1), then beads 76 would form in perforations 34.

Figure 7:
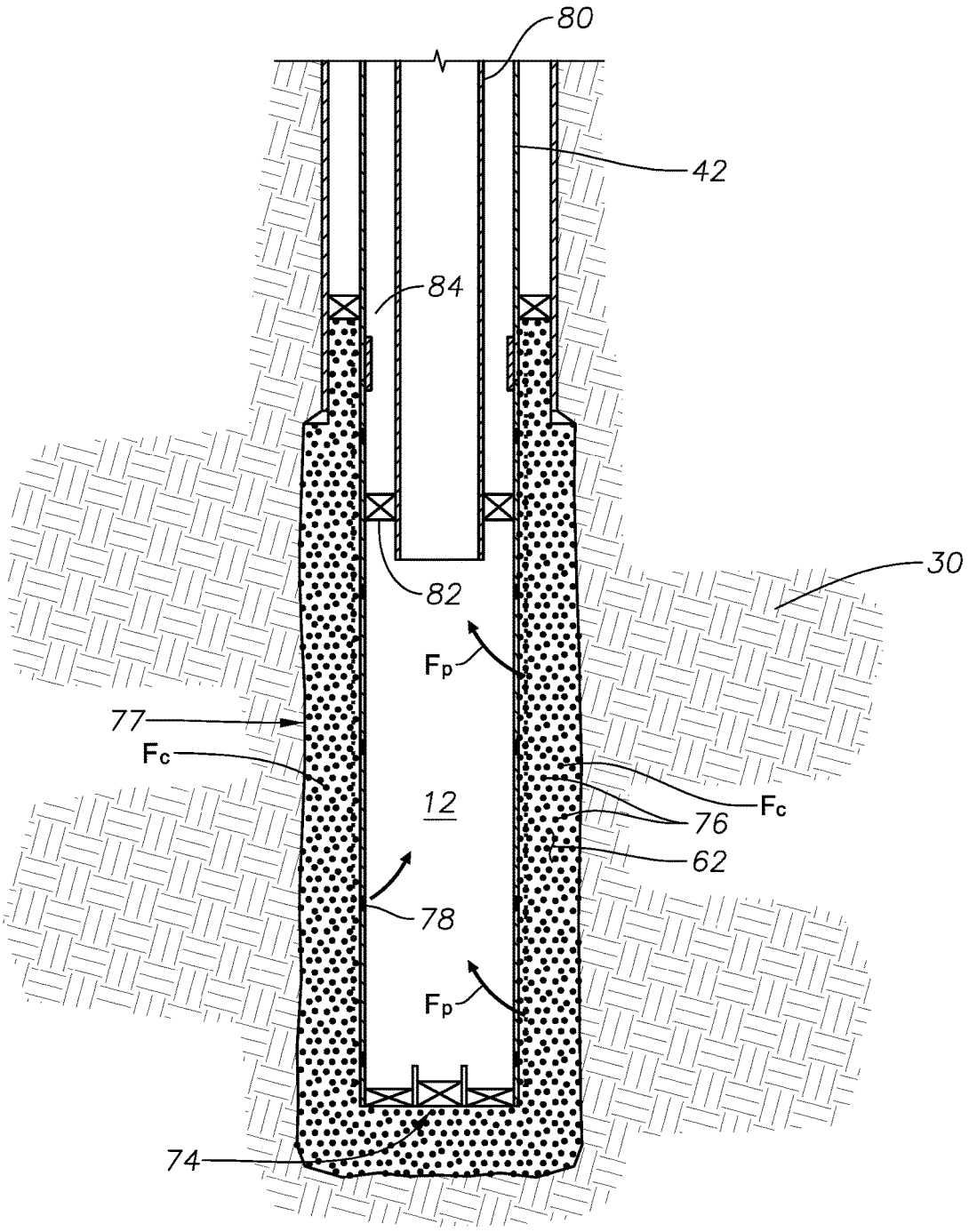
FIG. 7 is a side sectional view of the wellbore of FIG. 6 where fluid from the formation surrounding the wellbore is being produced.

As shown in side sectional view in FIG. 7 is another step of the gravel pack operations where the plugs 46 of FIG. 2 have dissolved to form opening 78 in the sidewall of the base pipe 42. By having the plugs 46 dissolve or otherwise lose their structural integrity, allows for communication from the annulus 62 and the portion of the wellbore 12 inside of the base pipe 42. As illustrated by arrows, production fluid $F_P$ is shown flowing upward within wellbore 12, and which is substantially free of particulate matter due to the presence of the gravel pack 77. In an embodiment, formation fluid $F_C$ within formation 30 flows from formation 30 and through the gravel pack 77, where particles and other material is filtered. That flowing out of the gravel pack 77 is referred to as production fluid $F_P$. Additionally, in the example of FIG. 7 production tubing 80 has been inserted within wellbore and a packer 82 set in the annulus 84 between the tubing 80 and base pipe 42. The production fluid $F_P$ is blocked from entering the annulus 84 by the packer 82, and thus is directed into the production tubing 80 where it is then routed to surface. A significant advantage is provided by the method described herein in that a minimal amount of hardware is used to deliver the bead forming fluid 60 within wellbore 12 for forming the gravel pack 77.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

The invention claimed is:

1. A method for gravel packing for use in a well, comprising:

introducing bead forming fluid into tubing having a portion that is inserted within a base pipe disposed in the well;

discharging the bead forming fluid from an end of the tubing disposed in the well to define discharged bead forming fluid;

routing the discharged bead forming fluid around an inner annulus formed between the tubing and the base pipe and into an outer annulus defined between the base pipe and sidewalls of the well;

retaining the bead forming fluid in the outer annulus; and forming a gravel pack in the well by controlling an operating condition of the bead forming fluid so that beads are formed in the outer annulus.

2. The method of claim 1, wherein the discharged bead forming fluid flows radially outward from the end of the tubing past a terminal end of the base pipe, and flows upward in the outer annulus.

3. The method of claim 1, wherein the bead forming fluid comprises primary and secondary liquid precursors to form the beads and wherein the beads are substantially spherical.

4. The method of claim 1, further comprising receiving a production fluid comprising one or more of liquid and gas from a formation that surrounds the well and that flows through the gravel pack.

5. The method of claim 4, further comprising pumping a volume of the bead producing fluid into the well that is substantially the same as a volume of a designated portion of the outer annulus.

6. The method of claim 1, wherein dissolvable material is disposed in an opening in a sidewall of the base pipe, the method further comprising maintaining conditions in the well that at which the dissolvable material degrades so that fluid communication occurs through the opening.

7. The method of claim 4, wherein the step of retaining the bead forming fluid in the outer annulus comprises the closing valve at a lower end of the outer annulus and closing a port at an upper end of the outer annulus to trap the bead forming fluid inside the outer annulus.

8. The method of claim 1, further comprising providing communication through a port in the sidewall of the base pipe, and flowing fluid through the port from the outer annulus.

9. The method of claim 8, wherein a sleeve is selectively disposed adjacent the port, and wherein communication through the port is provided by sliding the sleeve axially away from the port.

10. The method of claim 1, wherein the bead forming fluid flows into a perforation that intersects a formation surrounding the well, and wherein a gravel pack is formed in the perforation.

11. The method of claim 1, wherein the well comprises a type selected from the group consisting of a well lined with casing, an open hole well, and a well partially lined with casing.

12. A gravel pack system for use in a well comprising:

an annular base pipe disposed in the well and which defines an outer annulus between the base pipe and sidewalls of the well;

a device mounted in the base pipe and disposed proximate a terminal end of the base pipe;

a flow barrier in the outer annulus;

a screen circumscribing the base pipe;

an opening formed radially through a sidewall of the base pipe;

a material in the opening that degrades under certain conditions in the wellbore so that fluid communicates through the opening;

a port in a sidewall of the base pipe that is selectively opened and closed; and a tubular in the base pipe that is in selective communication with a source of a bead forming fluid and having a lower end inserted into an opening in the device and that is in communication with the outer annulus along a path past the terminal end of the base pipe, so that when the bead forming fluid is introduced into the tubular, the bead forming fluid is directed into the outer annulus and which forms a gravel pack in the outer annulus.

13. The system of claim 12, further comprising a valve in the device that is selectively closed to block communication through the opening in the device when the tubing is removed from the well.

14. The system of claim 12, wherein an inner annulus is defined between the tubular and the base pipe, and a flow barrier is disposed in the inner annulus that defines an upper end of the gravel pack, and wherein a lower end of the gravel pack is adjacent the terminal end of the base pipe.

15. A gravel pack system for use in a well comprising:

a base pipe selectively deployed in the well which defines an outer annulus between the base pipe and an inner wall of the well;

a dissolvable plug disposed in an opening formed through a side wall of the base pipe;

a tubular positioned within the base pipe that is in selective communication with a source of a bead forming fluid;

a device in a terminal end of the base pipe that receives an end of the tubular and that defines a flow barrier in an annular space between the tubular and base pipe so that a fluid flow path is formed from the end of the tubular, radially past the terminal end of the base pipe, and into the outer annulus; and bead forming fluid disposed along the fluid flow path and in the outer annulus.

16. The system of claim 15 wherein the dissolvable plug degrades in response to exposure to a downhole condition.

17. The system of claim 15, further comprising a screen circumscribing the base pipe.

18. The system of claim 17, wherein the screen interferes with entry of at least one of sand and beads into an inner annulus formed between the base pipe and the tubular.

19. The system of claim 15, further comprising a selectively opened and closed port formed radially through a sidewall of the base pipe disposed at an upper end of the outer annulus.

* * * * *